United States Patent [19]

Nishida

[11] Patent Number: 4,683,829

[45] Date of Patent: Aug. 4, 1987

[54] SMALL SELF-RIGHTING WATER CRAFT

[75] Inventor: Hiroshi Nishida, Miki, Japan

[73] Assignee: Kawasaki Jukogyo Kabushiki Kaisha, Kobe, Japan

[21] Appl. No.: 788,641

[22] Filed: Oct. 17, 1985

[30] Foreign Application Priority Data

Oct. 29, 1984 [JP] Japan ..... 59-227276

[51] Int. Cl.[4] ..... B63B 39/03

[52] U.S. Cl. ..... 114/125; 440/38

[58] Field of Search ..... 440/38; 114/61, 121, 114/125, 197, 198, 270

[56] References Cited

U.S. PATENT DOCUMENTS

| | | | |
|---|---|---|---|
| 132,695 | 5/1943 | Hort | 114/125 |
| 970,368 | 9/1910 | Frahm | 114/125 |
| 4,231,315 | 11/1980 | Tachibana et al. | 114/121 |
| 4,341,177 | 7/1982 | Miyazaki et al. | 114/125 |

*Primary Examiner*—Joseph F. Peters, Jr.
*Assistant Examiner*—Stephen P. Avila

[57] ABSTRACT

This disclosure relates to an arrangement for self-righting a water craft, such as water craft from an overturned position to a normal upright position. The craft comprises a substantially enclosed room and a reverse bilge well provided in both left and right side portions in an engine room.

5 Claims, 9 Drawing Figures

SMALL SELF-RIGHTING WATER CRAFT

BACKGROUND OF THE INVENTION (1) Field of the Invention

The present invention relates to a water craft or water-borne vehicle such as a small water craft, particularly of the jet propulsion-type water craft, and to a method of self-righting said water craft to normal upright position, when it has been overturned.

(2) Description of the Prior Art

The small water craft and the like may be operated at high speed and in sharp turn. As a result, the operator can enjoy a thrill at the high speed driving and in the sharp turn, but has the operational unstable condition when it is put in a sharp turn, and as a result it overturns.

As shown in FIGS. 1*a*, 1*b* and 1*c*, a conventional water craft of this type includes a hull 1 and an enclosed engine room 4 at a forward end, which is closed by a cover 3. The engine room 4 thus forms a float or buoyant body adjacent the bow 2. In FIG. 1*b* it will be seen that the center of gravity G of said float, and the center of buoyancy B of said float in FIG. 1*c*, and in the event the water craft overturns in the water. The center of buoyancy B is designed to be as high as possible, but the center of gravity G to be as low as possible. This arrangement so designed increases a vertical distance D between these centers B and G on a vertical center line L—L of the water craft, and as a result, the float is located at an upward portion of the bow 2, so that in the above conventional water craft, this bow 2 was made too bulky and stubby shaped. Thus, it has been a question that the shape of water craft can not be formed as a streamlined shape promoting a sporty and speedy impression.

As shown in the above, in the conventional water craft, the center of buoyancy B and the center of gravity G are located on the vertical center line L—L of the water craft, so that it is difficult for self-righting to the normal upright position quickly, when the water craft was overturned in the water. Furthermore, if a weight or ballast is added to a bottom of the water craft, the total weight is increased, so that the water craft is difficult to transport, which is an important factor for a small recreational water craft.

SUMMARY OF THE INVENTION

A small water craft according to the present invention includes an engine room providing reverse bilge wells of the room in a bottom of the water craft. The bilge water is moved and flowed into either bilge well when the water craft is overturned, and increasing a force couple, which is produced by the weight and the buoyancy of the water craft to normal upright position by means of a deviation of the bilge water, thereby accelerating the self-righting of the water craft to the normal upright position.

DESCRIPTION OF THE PREFERRED EMBODIMENTS

While the present invention will be described more fully hereinafter with reference to the accompanying drawings, in which particular embodiments of the present invention are shown, it is to be understood at the outset of the description which follows that persons of ordinary skill in the appropriate arts may modify the invention here described while still achieving the favorable results of this invention.

Figure 1A:
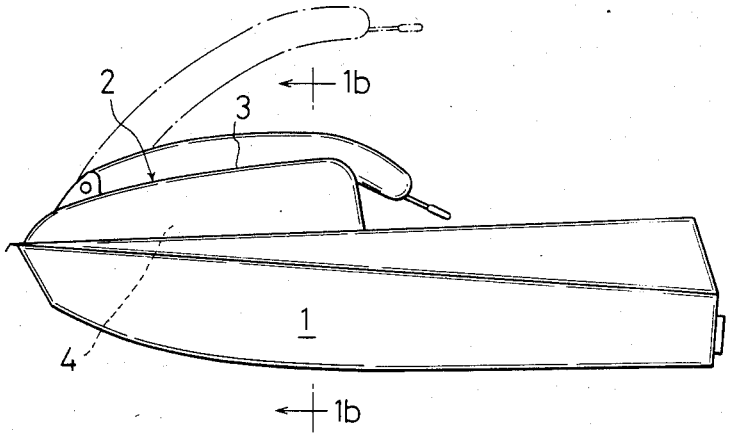
FIG. 1a PRIOR ART
FIG. 1*a* is a side view of a conventional water craft.
Figure 1B:
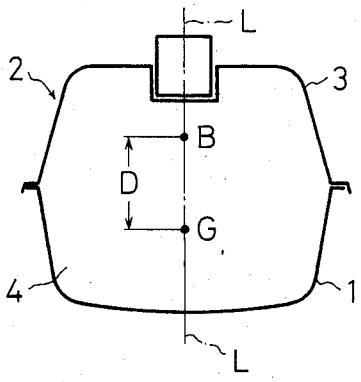
FIG. 1b PRIOR ART
FIG. 1*b* is a cross-sectional of a bow of the water craft taken on the line 1*b*—1*b* of FIG. 1*a;*
Figure 1C:
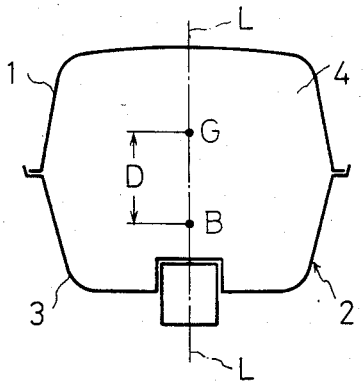
FIG. 1c PRIOR ART
FIG. 1*c* shows the water craft of FIG. 1*b* in an overturned position.
Figure 2A:
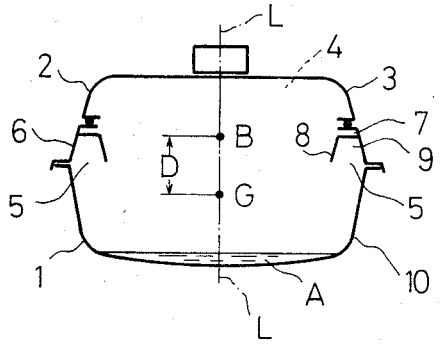
FIG. 2*a* is a cross-sectional view of a bow of the water craft according to an embodiment of the invention.
Figure 2B:
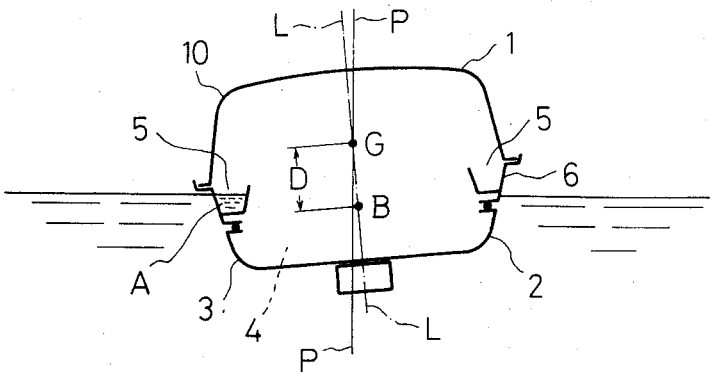
FIG. 2*b* is a cross-sectional view of the bow shown in FIG. 2*a* in overturned position.

Referring now more specifically to the drawings, FIGS. 2*a* and 2*b* illustrate a water craft, particularly of the jet propulsion-type water craft in accordance with the present invention. A hull 1 of the water craft includes an engine room 4. An engine, auxiliary and accessory device (not shown) are also mounted in the engine room 4. The room 4 is defined by a removable engine room cover 3 arranged at said upward portion of a bow 2. Thus, the upward portion of the engine room 4 is closed in waterproof condition by the cover 3 during the operation, and the closed engine room 4 thereby is formed as a float or buoyant body. The center of gravity G lies on the lower portion of the float. Line P—P is a perpendicular through the center of gravity G of the float to water level, and line L—L is a proper center line through the center of gravity G of the float. The water craft has an increased vertical distance D between these centers B and G on a vertical center line L—L of the water craft. Furthermore, a reverse bilge well or compartment 5 is provided in both left and right side portions longitudinally of the engine room 4. These bilge wells 5 consist of a bottom plate 7 and a side plate 8 in "reverse L"-shape in an inner side of the upper outer plate 6 at the upper portion of the hull 1, and the bilge wells 5 are also provided with an end plate 9 at the front and rear ends of the longitudinal direction. These "reverse L"-shape well constructions are alike with downwardly opened troughs at a normal operating condition of the water craft.

Generally, in the water craft, a force couple in the returning direction is generated by the weight of the hull 1 and by the buoyancy of floating body when the craft is overturned in an imbalanced condition at the high speed driving and sharp turn, and as a result, the hull of the overturned craft becomes difficult in self-righting said hull to the normal upright position, and the water craft comes into a stabilized condition at the angle of substantially 180 degree rotation of said hull, and more difficult for the operator who is now swimming in the water to upright from any overturned position. However, in accordance with the present invention, when the water craft is overturned as shown in FIG. 2*b*, a bilge water A in a bottom of the craft is moved along a lower outer plate 10 to a direction, into which the hull was rotated, and entered into the bilge well 5 in either the left and the right side which is arranged in the inner side of the upper outer plate 6 as shown in FIG. 2*a*. In this case, the hull 1 is inclined with this deviation of the bilge water A, and the weight of the overturned hull is moved to one side and then the hydrodynamic force couple produced by the weight of the craft and by the buoyancy of the floating body is applied to the hull. Consequently, according to in the present invention, the overturned craft can be forced to right immediately and stabilized to the normal upright position with little or no effort of the operator.

Figure 3:
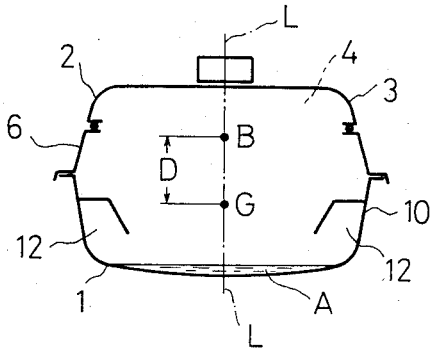
FIGS. 3 and 4 are cross-sectional views of the bow of the water craft according to another embodiment of the invention.

In another embodiment as shown in FIG. 3, the bilge wells 12 can be provided in an inner side of the outer plates 10 of hull 1. In this case, the "reverse L"-shape bilge wells 12 can be formed in both left and right sides of said lower outer plates 10.

Figure 4:
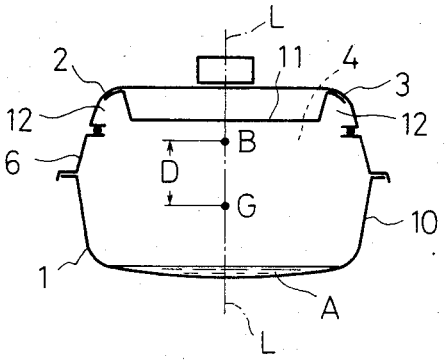
Figure 5A:
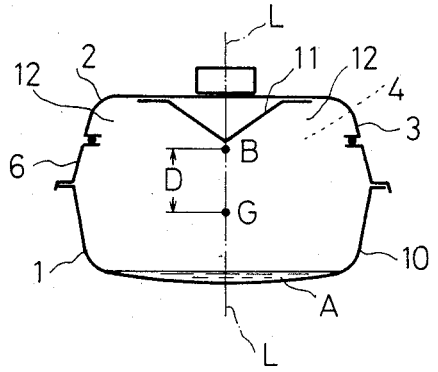
FIGS. 5*a* and 5*b* are cross-sectional views of the modified constructions of ceiling wall in the embodiment of FIG. 4.
Figure 5B:
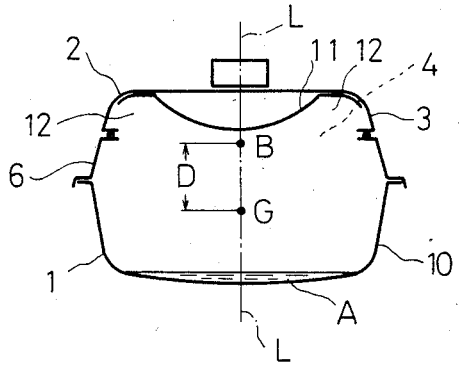

In another embodiment as shown in FIG. 4, the bilge wells 12 can be provided on the inside of a ceiling wall 11, which is mounted on an interior part of the engine room cover 3. The ceiling wall 11 is formed to define longitudinally extending bilge wells 12, which at both left and right side edges are formed as reverse grooved troughs. The ceiling wall 11 is not limited only to the construction as shown in FIG. 4 and can be preferably constructed as shapes as shown in FIGS. 5*a* and 5*b*. In the case that the bilge wells 12 are defined by the ceiling wall 11 as shown in FIGS. 5*a* and 5*b*, a space is formed between the ceiling wall 11 and the engine room cover 3, and said space can be used as an air duct.

When the water craft moves in its normal position in water and after landed, a drain (not shown in the FIGS.) may be opened by automatic or manual operation to discharge the bilge water and as a result, the weight of the water craft can be reduced, thereby the water craft can be easily transported by the user.

What is claimed is:

1. A self-righting water craft comprising a hull, a substantially enclosed engine room in said hull a reverse bilge well provided in both left and right side portions in said engine room, and a means for moving and flowing a bilge water in a bottom of the water craft into either said bilge well when said water craft is overturned to increase a force couple, which is produced by the weight and buoyancy of said water craft in the direction to right said water craft to normal upright position by means of a deviation of the bilge water, thereby accelerating the self righting of said water craft.

2. A water craft as claimed in claim 1 wherein said bilge wells are provided in an inner side of an outer plate at an upper portion of the hull.

3. A water craft as claimed in claim 1 wherein said bilge wells are provided in an inner side of an outer plate at a lower portion of the hull.

4. A water craft as claimed in claim 1 wherein said bilge wells are defined in both left and right sides of a projecting portion of a ceiling wall.

5. A method of self-righting an overturned water craft to normnal upright position, said water craft including an engine room, said method comprises providing reverse bilge wells of the room in a bottom of the water craft; moving and flowing a bilge water into one bilge well when said water craft is overturned; and increasing a force couple, which is produced by the weight and the buoyancy of said water craft in the direction to right said water craft to normal upright position by means of a deviation of the bilge water, thereby accelerating the self-righting of said water craft to the normal upright position.

* * * * *